United States Patent [19]

Holloway

[11] 4,059,981

[45] Nov. 29, 1977

[54] BLIND RIVETING TOOLS

[75] Inventor: David John Holloway, Aldridge, England

[73] Assignee: USM Corporation, Boston, Mass.

[21] Appl. No.: 725,530

[22] Filed: Sept. 22, 1976

[30] Foreign Application Priority Data

Jan. 22, 1976 United Kingdom ..... 2412/76

[51] Int. Cl.[2] ..... B21J 15/34

[52] U.S. Cl. ..... 72/391; 72/453.17

[58] Field of Search ..... 72/391, 453.17

[56] References Cited

U.S. PATENT DOCUMENTS 2,340,066 1/1944 Lee ..... 72/391

2,570,801 10/1951 Hamlin ..... 72/391

FOREIGN PATENT DOCUMENTS 447,919 4/1948 Canada ..... 72/391

582,428 11/1946 United Kingdom ..... 72/391

*Primary Examiner*—C.W. Lanham

*Assistant Examiner*—Gene P. Crosby

*Attorney, Agent, or Firm*—Carl E. Johnson; Richard B. Megley; Vincent A. White

[57] ABSTRACT

A pull-to-set mandrel riveting tool is provided with mandrel-pulling jaws releasable from mandrel gripping relation, and a pivoted nosepiece assembly including openable rivet abutting means is thereupon movable to carry the mandrel to an out-of-the-way position wherein a rivet to be set can be loaded on the stem of the reusable mandrel. The tool is preferably operable by fluid pressure means, and a stop means is provided for insuring proper longitudinal re-positioning of the mandrel relative to mandrel pulling means. The construction facilitates manual or automatic loading of successive rivets on the mandrel.

8 Claims, 9 Drawing Figures

BLIND RIVETING TOOLS

BACKGROUND OF THE INVENTION

This invention is concerned with improvements in or relating to blind riveting and is especially concerned with tools for use in setting the rivets of pull-through blind-riveting assemblies.

The expression "pull-through blind riveting" is used herein to denote a procedure in which a shank of a tubular rivet having a head at one end, assembled on a stem of a mandrel which has a head which is too large to pass through the rivet shank without deforming it, is inserted in a hole in a workpiece from one side, in such a manner that the head abuts the workpiece at said one side and the shank projects from the workpiece at the other side, and the rivet is set by pulling the mandrel stem at said one side of the workpiece while holding the head of the rivet against the workpiece whereby the mandrel head effects radial expansion of the rivet shank at the other side of the workpiece and is thereafter pulled right through the rivet.

It is customary in pull-through blind riveting to use a rivet-setting tool which has a mandrel with a long stem on which a number, for example 25, rivets are assembled, the rivets being set one after another upon reciprocation of the mandrel and forward feeding of the rivets up to the mandrel head. After all the rivets on the mandrel have been set, the mandrel is removed from the tool and reloaded with fresh rivets. It has also been proposed to provide a rivet-setting tool in which a long mandrel is held captive by two sets of gripping means, one of which serves to pull the mandrel stem, which can be released alternatively to allow the rivets fed to the tool one at a time to be fed forwardly along the mandrel stem. The use of a long mandrel not only involves the construction of a longer tool than might otherwise be necessary, but a mandrel to be used for setting successive rivets is in itself an expensive item, and the longer it is, the more costly it is to manufacture. Advancing of rivets along a mandrel stem in a tool to which they are fed one by one, the tool having jaws to grip and pull the mandrel stem, avoids having to remove the mandrel for reloading, but so far as we are aware, such proposals as have been made hitherto, have involved a construction of tool in which the jaws can be separated by a distance sufficient to allow passage therebetween of the rivets, that is to say, by much more than is necessary merely to release the grip of the jaws on the mandrel.

SUMMARY OF THE INVENTION

It is one of the various objects of the present invention to provide an improved rivet-setting tool adapted for use in pull-through blind riveting, to which rivets can be fed one at a time without removing the mandrel which is used to set them.

There is hereinafter described the detail to illustrate the invention by way of example a pull-through blind riveting tool comprising a housing, mandrel-pulling means comprising a jaw case and a plurality of jaws reciprocably mounted in the housing, and an abutment assembly including abutment members pivotally mounted on an abutment support which is itself pivotally mounted to swing about an axis at right angles to the direction of reciprocation of the jaw case. The abutment members of this illustrative tool, when closed, provide an abutment to engage a rivet head during rivet-setting, but can be separated, by swinging on their pivots, to allow passage therebetween of the rivets. The pivotal mounting of the abutment assembly on the housing of the illustrative tool constitutes means interconnecting them with provision for relative movement of separation and approach therebetween to allow access to the rear end of the mandrel of the tool, which is supported in the abutment assembly when the assembly is swung away from the housing after release of the mandrel by the jaws so that a fresh rivet can be assembled on to the mandrel stem. Latch means, in the form of a sleeve slidably mounted on the housing, holds the abutment assembly and the housing in alignment in a ready-to-set condition of the tool in which the jaws are closed in gripping engagement with the mandrel. Retraction of the sleeve both releases the grip of the jaws and permits swinging of the abutment assembly to effect bodily separation of the mandrel and the mandrel-pulling means.

The illustrative tool also comprises stop means arranged to engage the mandrel head and ensure correct positioning of the mandrel lengthwise of the jaw case before the jaws re-engage the mandrel after loading of a fresh rivet.

The illustrative tool is pneumatically operated, and piston means is arranged to open the abutment members as the pulling means advances after setting the rivet, while air blows a fresh rivet, previously disposed on the mandrel, along the mandrel stem to the mandrel head in front of the abutment members. Air for this purpose flows from the housing, and such flow is terminated by sealing means provided therefor when the pulling means reaches its foremost position.

The mandrel of the illustrative tool has an enlarged portion at an intermediate position along its stem large enough to preclude the mandrel from falling from the tool between the closed abutment members, but not large enough to impede the passage of a rivet as it is being blown along the mandrel stem.

The illustrative tool is of compact construction and is readily maneuverable when held in the operator's hands. The jaws of the pulling means are arranged to open and close with only sufficient movement to release and grip the mandrel stem. The mandrel itself is short, compared with mandrels normally used for pull-through blind riveting, and therefore relatively inexpensive. The illustrative tool enables riveting operations to be carried out in rapid sequence, loading one rivet at a time.

The invention provides, in one of its several aspects, a pull-through blind-riveting tool comprising a housing, and mandrel-pulling means reciprocably mounted in the housing, the mandrel-pulling means comprising jaws arranged to grip and pull a mandrel and normally being in gripping engagement with the mandrel stem, the tool also comprising means for releasing the mandrel from the jaws, means for effecting bodily separation of the mandrel and the mandrel-pulling means to allow a fresh rivet to be assembled on the mandrel stem, and means for enabling the loaded mandrel to be returned into gripping engagement by the jaws.

The invention also provides, in another of its several aspects, a pull-through blind-riveting tool comprising a housing, mandrel-pulling means reciprocably mounted in the housing, and an abutment assembly including abutment means which can be opened to allow passage of a head of a rivet therebetween and closed to provide an abutment to engage the rivet head during rivet-setting, the tool also comprising means interconnecting the abutment assembly and said housing with provision for relative movement of separation and approach therebetween to allow access to the rear end of a mandrel supported in the abutment assembly when the assembly and housing are separated so that a rivet can be assembled on the mandrel stem.

The invention also provides, in another of its several aspects, a pull-through blind-riveting tool comprising a housing, mandrel-pulling means reciprocably mounted in the housing, and an abutment assembly including abutment members which can be separated to allow passage of a headed rivet therebetween and closed to provide an abutment to engage the rivet head during rivet-setting, means for releasing the mandrel from the mandrel-pulling means, means for effecting bodily separation of the mandrel-pulling means and the mandrel to permit access to the rear end of the mandrel so that a rivet can be assembled on the mandrel stem, and for causing the mandrel-pulling means to re-engage the mandrel stem, and stop means arranged to be engaged by the mandrel to ensure its being correctly positioned lengthwise of the mandrel-pulling means when so re-engaged.

The stop means, in a tool as set out in the last preceding paragraph, may, as is the case with the illustrative tool, take the form of a stop member engageable by the mandrel head in front of the abutment members, or alternatively, it may be accommodated within the tool for engagement with a shoulder on the mandrel stem, for example being provided by rear edges of the abutment members.

Although the illustrative tool is intended to be fed with rivets one at a time by hand, a tool in accordance with the invention may be arranged to be fed with rivets automatically. If the tool is to be held in the hand of an operator, the rivets may conveniently be blown through a flexible hose to a delivery point from which they can be released for assembly on the mandrel stem. If the tool is mounted in a fixed location, for example on a bench, rivet delivery may alternatively be arranged by means including a raceway. For automatic feeding it is preferable to arrange for separation of the mandrel-pulling means and the mandrel after release of the mandrel stem by means other than the pivoting of the abutment assembly about an axis at right angles to the direction of reciprocation of the mandrel-pulling means, as is the case with the illustrative tool. If the relative movement between the abutment assembly and the housing of the mandrel-pulling means is provided for, such means may be arranged to effect separation along the direction of reciprocation of the mandrel-pulling means, or, if such separation is not provided for, the mandrel-pulling means may be arranged to retract, for example, after release of the mandrel.

BRIEF DESCRIPTION OF THE DRAWINGS

There now follows a detailed description, to be read with reference to the accompanying drawings, of the illustrative tool. It will be realized that this illustrative tool has been selected for description by way of example and not of limitation of the invention.

In the accompanying drawings.

DESCRIPTION OF PREFERRED EMBODIMENT

Figure 1:
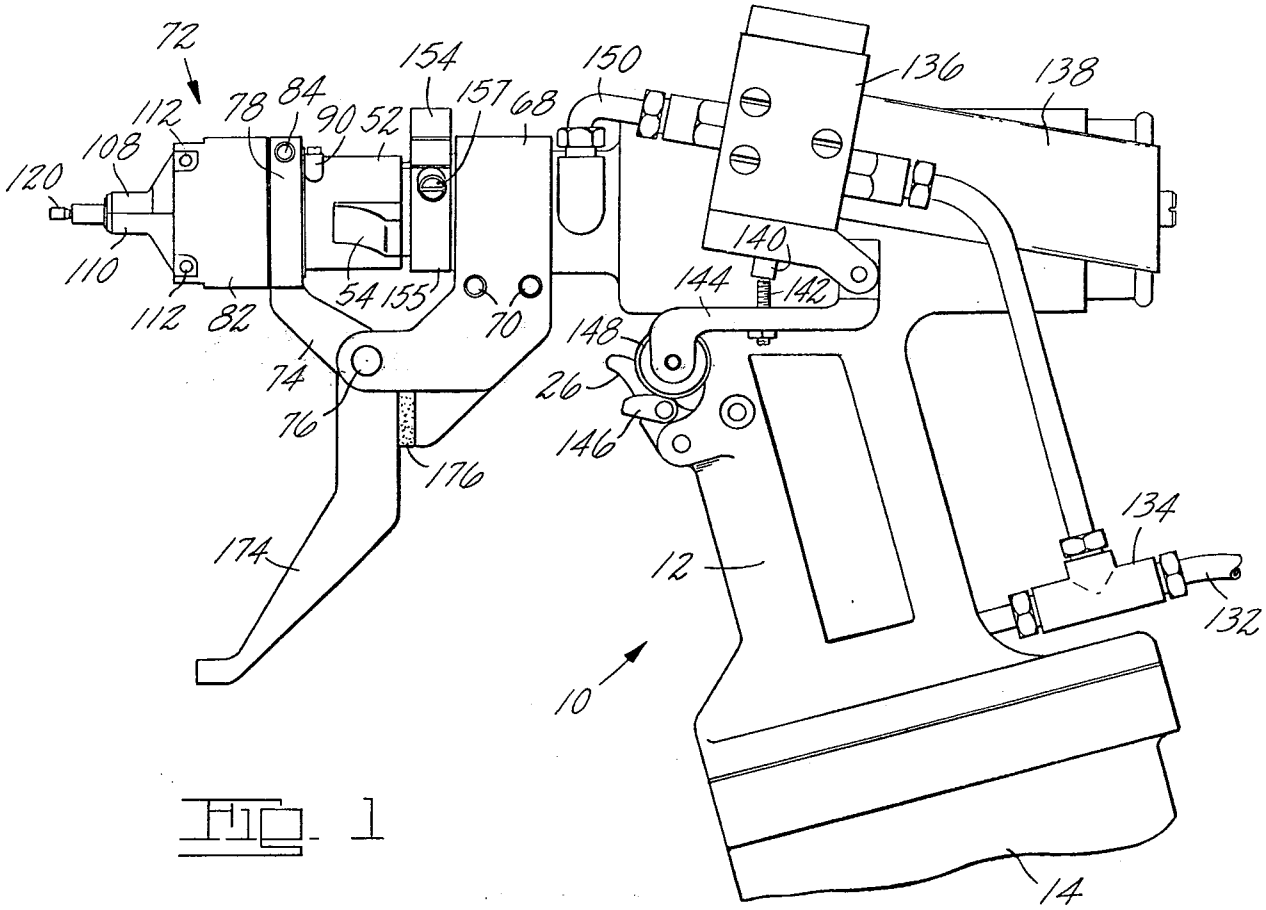
FIG. 1 is a view in side elevation of an upper portion of the illustrative tool, the tool being in the ready-to-set condition.

FIG. 1 is drawn to a smaller scale than FIGS. 6 to 9, and FIGS. 2 to 5 to a larger scale.

The illustrative tool comprises a body 10 which provides a hand grip 12, pneumatic cylinder 14 and housing 16. The hand grip 12 has a bore (not shown) which contains hydraulic fluid and into which a piston rod secured to a piston in the cylinder 14 projects. Fluid from said bore can pass through a passageway in the body into a hydraulic cylinder provided in the rear portion (i. e. right-hand end portion viewing FIG. 1) of the housing when air under pressure is admitted to the cylinder 14 below said piston, to act on a piston by which a power coupling 20 (FIG. 2) is to be pulled rearwardly. A return spring 22 acts on an external flange 24 of a sleeve portion of the coupling to return hydraulic fluid to said bore when air pressure below the piston in the cylinder is exhausted. Actuation of the piston in the cylinder 14 is effected by shifting a trigger 26 on the hand grip. The foregoing construction of pneumatic/hydraulic blind-riveting tool is well-known, and will not be described further herein. An example of such a tool is described in U.S. Pat. No. 3,254,522 to Elliott et al.

Figure 2:
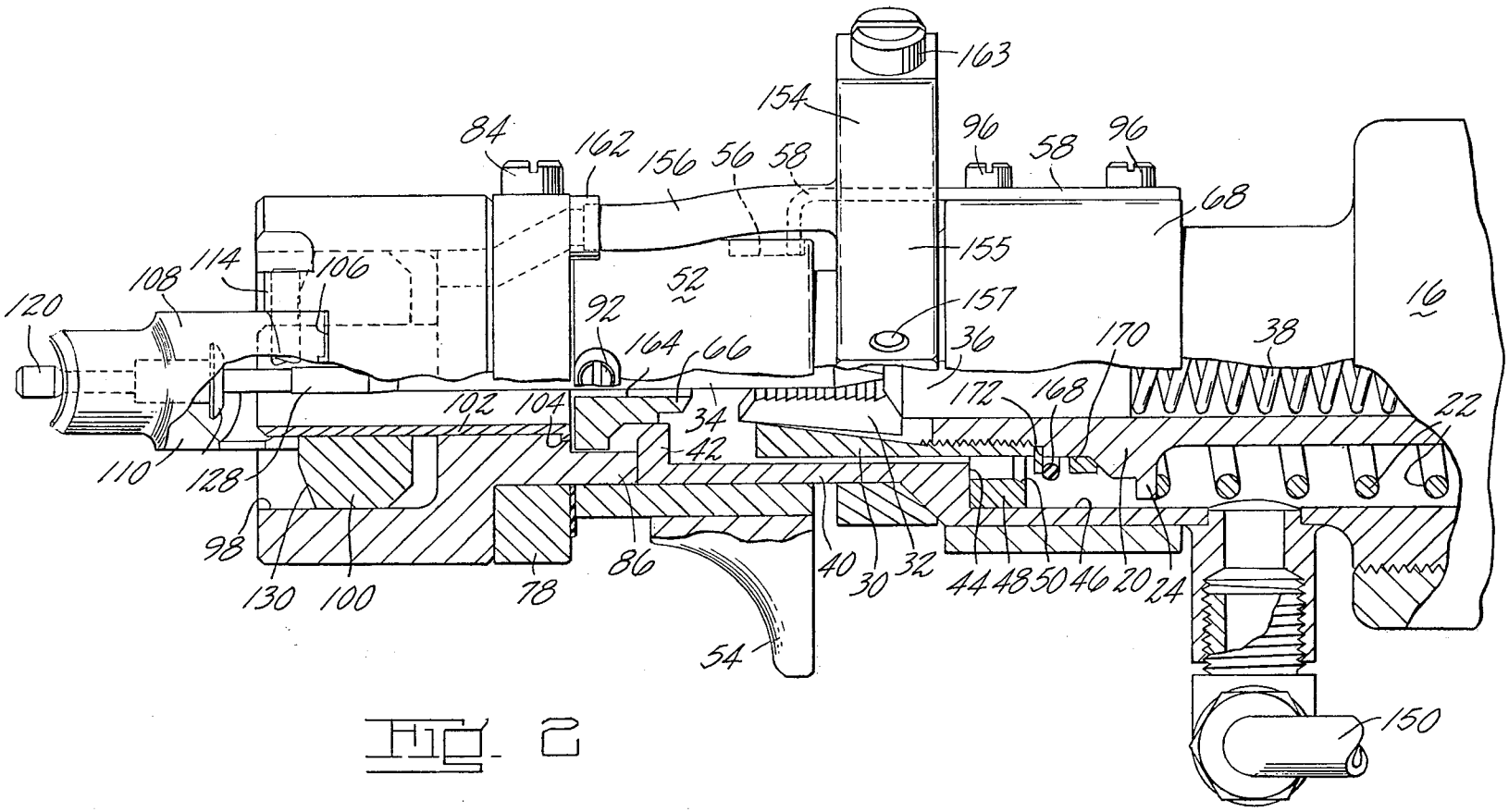
FIG. 2 is a plan view, partly in section, of part of the illustrative tool, at a stage in its operation when a rivet is being blown forwardly along the mandrel stem.
Figure 4:
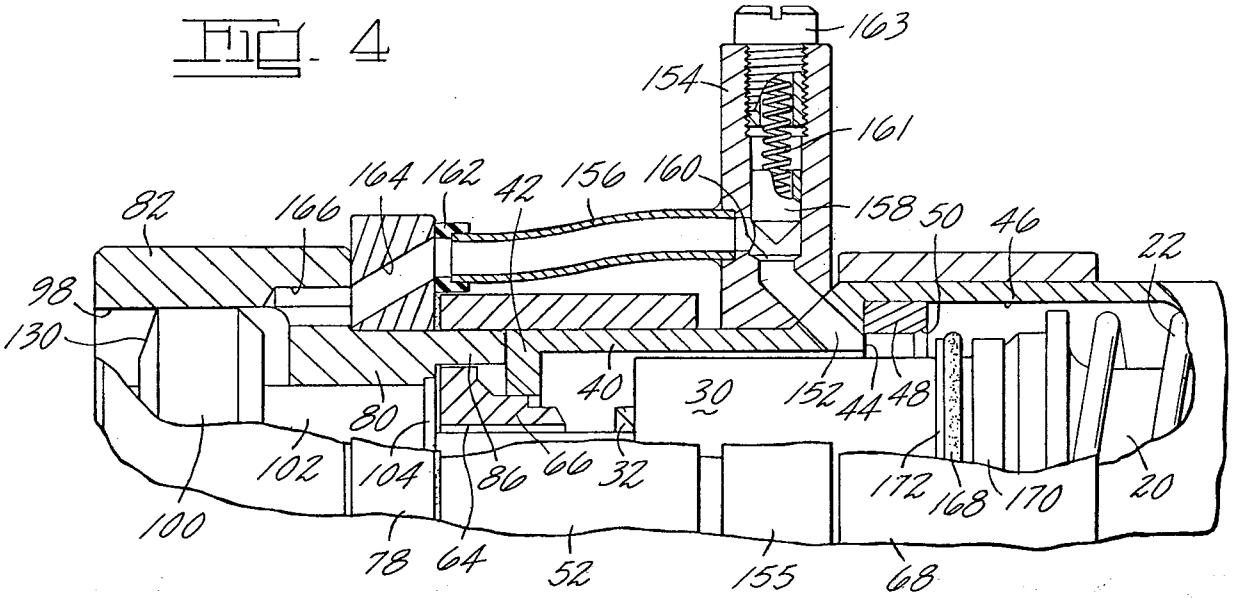
FIG. 4 is a fragmentary view of parts of the illustrative tool in the positions indicated in FIG. 2, shown in section along the line IV—IV of FIG. 3.

As best seen in FIGS. 2 and 4, a jaw case 30 is screwed on to a forward end portion of the power coupling 20 of the illustrative tool, the jaw case 30 having a conical internal surface which cooperates with a set of three jaws 32 in a conventional manner to grip a stem of a mandrel 34 (FIGS. 2 and 5 to 9). The jaws 32 are constantly urged forwardly (i.e. to the left viewing FIG. 2) by a pusher 6 under the influence of a spring 38 accommodated in the coupling 20. The jaw case 30 projects into a sleeve portion 40, of reduced diameter, of the housing 16. The portion 40 terminates at its front end in an internal annular lip 42, and at its rear end provides an annular shoulder 44 where it meets a larger diameter bore 46 in the housing. A collar 48, with a larger internal diameter than the portion 40, is fixed in the bore 46 against the shoulder 42 for a purpose which will appear later; a rear edge of the collar 48 has a chamfer 50.

Freely mounted to slide on the portion 40 of the housing 16 of the illustrative tool is a latching sleeve 52 with a radially projecting finger piece 54 at one side to facilitate its being pulled rearwardly by an operator. At its other side, the sleeve 52 has a longitudinal slot 56 in which an inwardly bent end portion of a retaining bar 58 is accommodated to prevent rotation of the sleeve; a rear end of the slot restricts forward movement of the sleeve. At its front end, the sleeve 52 is bridged by a web 60 (FIG. 3) which is shaped to leave two symmetrically disposed arcuate slots 62 between it and the wall of the sleeve, one at each side. A central portion of the web 60 has a hole 64 through it, and at its rearward side has a boss 66 which projects into the portion 40 of the housing, where the boss slides in contact with the lip 42. The rearward end of the boss 66 is conical; the hole 64 in the web extends right through the boss. The jaws 32 have part conical inner surfaces at their front and rear ends to cooperate with the rearward end of the boss 66 and a conical front end of the pusher 36, respectively, in a conventional manner to cause the jaws 32 to separate, i.e. open, when urged rearwardly relative to the jaw case 30 by the boss 66 against the influence of the spring 38.

Mounted on a strap 68 (FIGS. 1 and 2) which is clamped to the housing 16 of the illustrative tool by bolts 70 is an abutment assembly 72 which constitutes a forward end portion of the tool; a yoked arm 74 of the assembly is mounted between a yoked portion of the strap 68 on a pivot pin 76. The pin has its axis at right angles to the direction of reciprocation of the jaw case. The arm 74 provides a split sleeve portion 78 which clamps a rearwardly projecting (viewing FIGS. 2 and 4) sleeve portion 80 of an abutment support 82, clamping being effected by a bolt 84. Projecting rearwardly from the portion 80 of the support 82 are two arcuate lugs 86, complementary in shape to the slots 62 in the latching sleeve 52 so that, when the arm 74 is swung up about the pivot pin 76 from the position shown in FIG. 8 to that in FIGS. 2 and 5, the lugs 86 slide into the slots 62, the sleeve 52 being momentarily pushed rearwardly against the influence of the spring 38 acting through the pusher 36 and jaws 32 and then being restored to its foremost position to latch the support 82 in alignment with the housing 16; the lugs 86 then abut the front end of the sleeve portion 40. A detent 88 (FIG. 3) mounted on a leaf spring 90 secured to the sleeve 52 by a screw 92 projects through a hole in the sleeve and into a recess 94 in one of the lugs 86 to resist accidental release of the support 82 from the latching sleeve 52.

The support 82 of the abutment assembly of the illustrative tool includes a portion in the form of a circular block with a cylindrical recess 98 (FIG. 2) open at the front. An annular piston 100 is freely slidable in the recess on the tubular shaft 102 co-axial with the jaw case 30 (when the support 82 is latched in the position shown in FIGS. 2 and 5). The shaft has an external flange 104 at its rear end accommodated in an annular recess in the sleeve portion 80 of the support to hold it in position.

Figure 3:
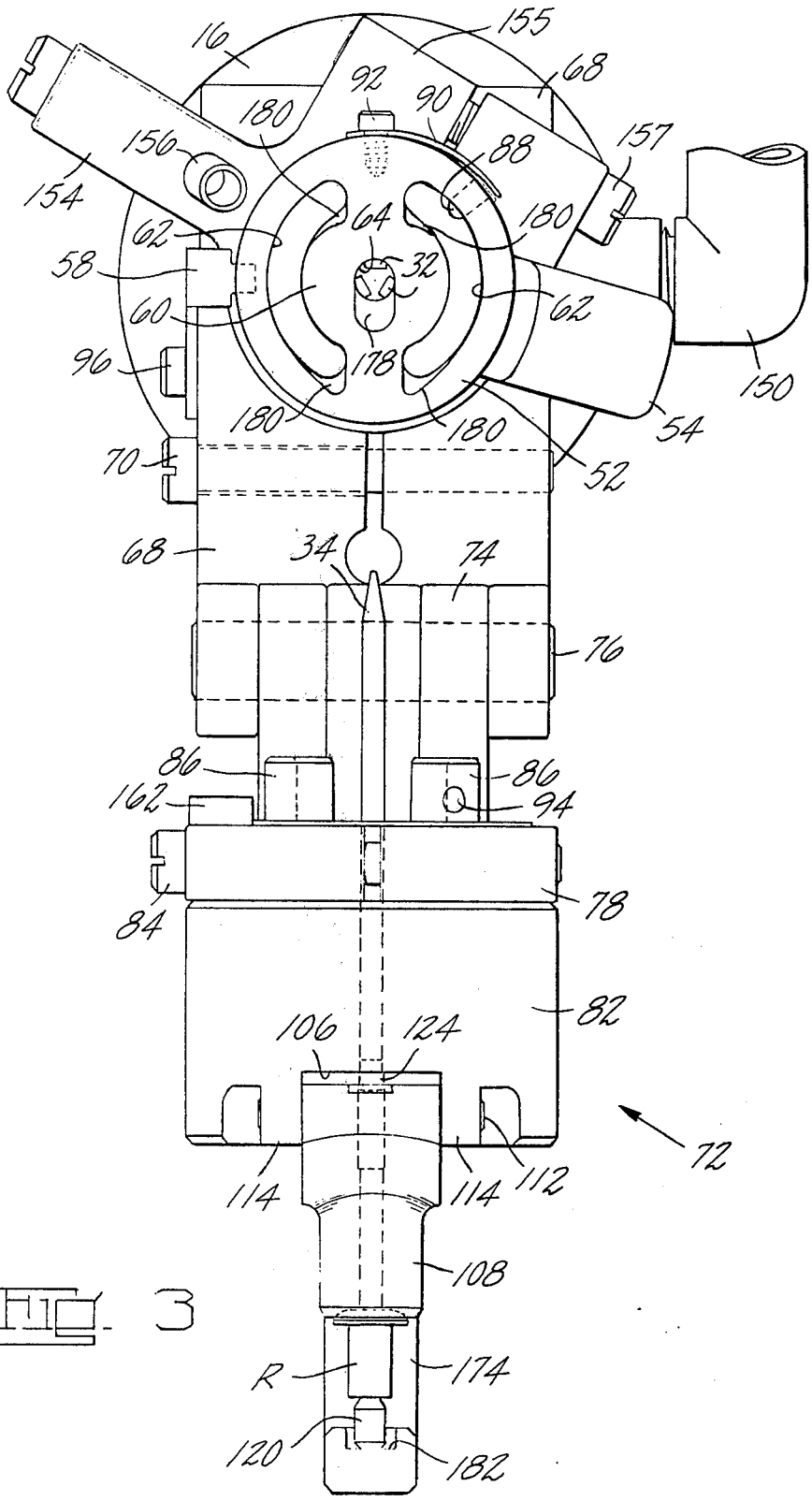
FIG. 3 is a front view of the illustrative tool shown in FIG. 2, with a forward end portion of the tool, which includes abutment means thereof, shown in the loading position.
Figure 5:
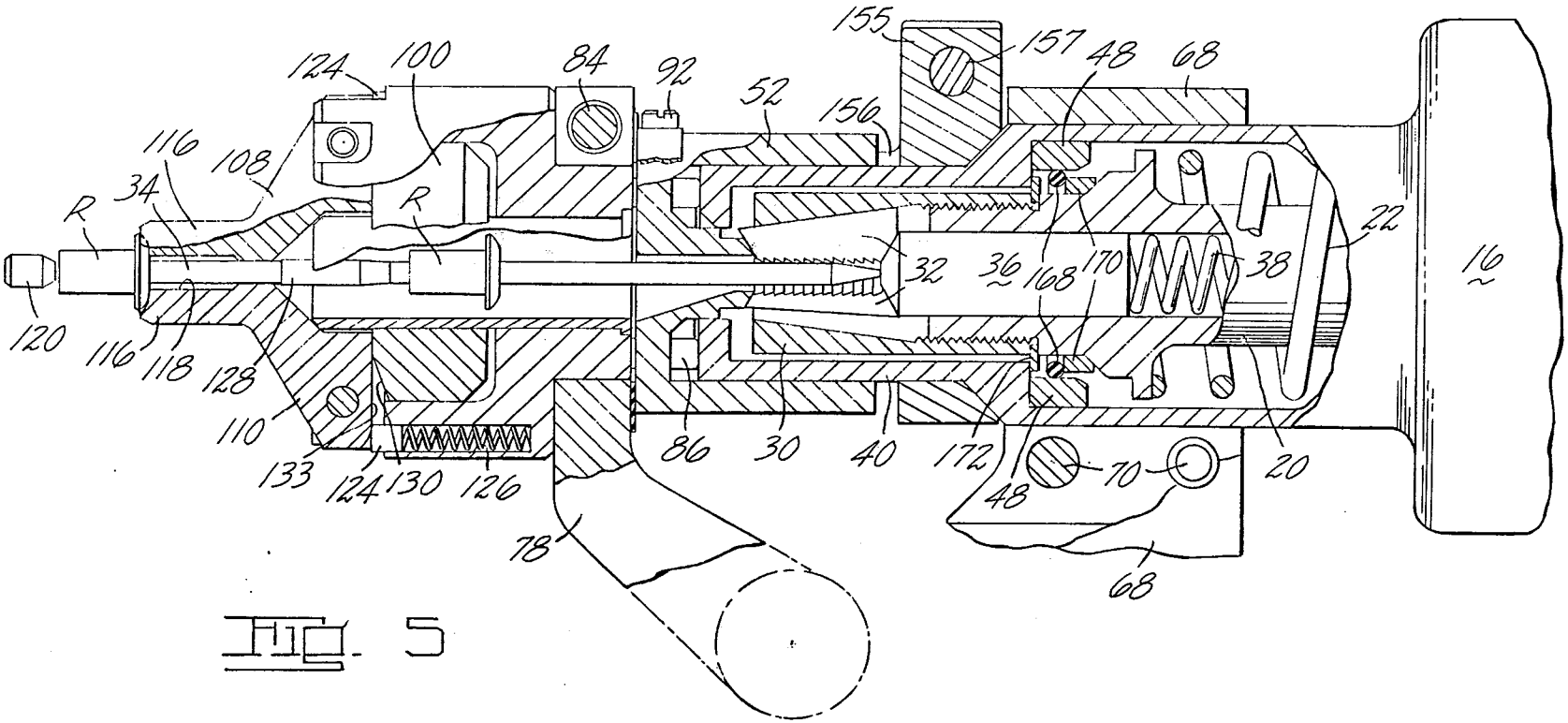
FIG. 5 is a view in side elevation and partly in section of part of the illustrative tool in the same condition as it is shown in FIG. 1.

At its front end, the support 82 has cut-away portions to provide upper and lower recesses 106 in which upper and lower abutment members 108 and 110 are pivoted, being mounted on pins 112 in residual lugs 114 (FIGS. 3 and 5). As can be seen best from FIGS. 6 and 7, each abutment member 108,110 has a forwardly projecting semi-cylindrical portion 116 longitudinally grooved internally so that, when the members are in closed, abutting relationship to one another, there is a cylindrical cavity 118 between them sufficient to accommodate a head 120 of the mandrel 34 when, as will appear hereinafter, it is axially pulled clear of the rivet. Behind this recess, when the members are closed, is a more restricted passage 122 (FIG. 6) which serves as a guide for the mandrel stem. The members 108,110 are urged into their closed positions by spring-pressed plungers 124 accommodated in bores 126 in the support 82. Front surfaces of the members 108,110 are complementary in shape to the heads of rivets with which the tool is intended to be used.

The mandrel 34 is shown in FIGS. 2 and 5 where it is seen to have an enlarged portion 128 part way along its stem from its head 120. A headed hollow rivet R is shown on the mandrel adjacent the head 120 in FIG. 5 and on its way towards the head in FIG. 2. The enlarged portion 128 of the mandrel stem is not large enough to interfere with the free passage of the rivet along the stem, but it will not pass through the passage 122 when the members 108,110 are closed, thus, as will be seen, precluding the mandrel from falling out of the tool when it is released by the jaws 32.

Figure 6:
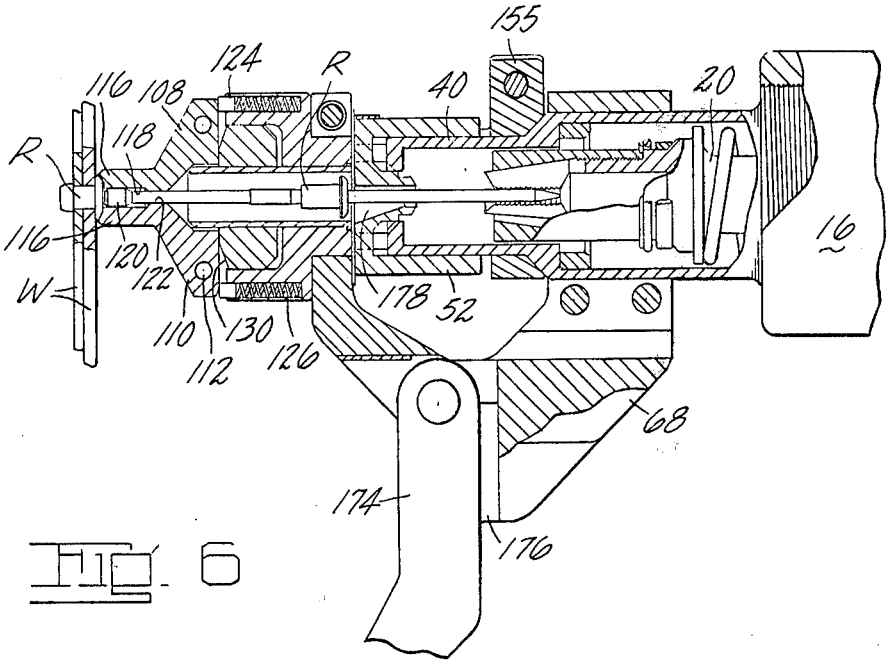
FIG. 6 is a view similar to FIG. 5, but showing parts disposed as at the end of a rivet-setting stroke of pulling means of the tool.
Figure 7:
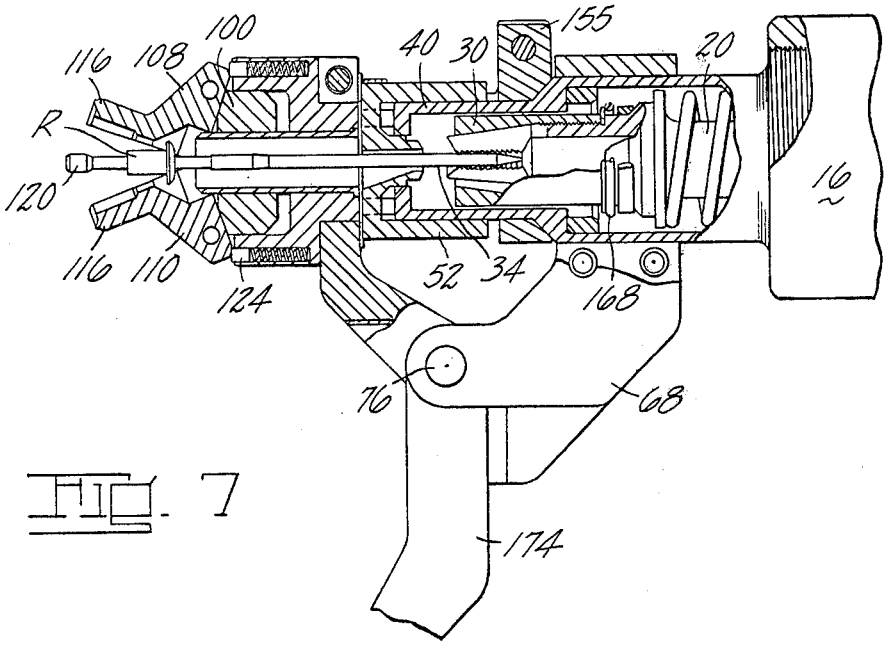
FIG. 7 is a view similar to FIGS. 5 and 6 but showing the illustrative tool at the stage, also depicted in FIG. 2, when the rivet is being blown forwardly along the mandrel stem.

Opening of the abutment members 108,110 in the operation of the illustrative tool is effected by the piston 100, a front face 130 of which is part conical, with a very obtuse apical angle, so that it can cooperate with flat rear faces 133 of the members 107,110 when the piston is advanced (i.e. to the left, viewing FIGS. 6 and 7) to swing the members about the pins 112 to their open positions shown in FIG. 7. In their open positions, the members are wide enough apart to allow the rivet R to pass between them. Actuation of the piston 100 to open the members 108,110 is effected in the operation of the illustrative tool upon release of the trigger 26 as will now be described.

Compressed air from a suitable source reaches the illustrative tool through a hose 132 (FIG. 1), which is coupled to a T-junction 134 so that air passes both to the cylinder 14 via a valve actuated by the trigger 26 (air being admitted below the piston in the cylinder to initiate retraction of the power coupling 20 in a rivet-setting stroke on squeezing of the trigger) and to a valve 136 mounted on a bracket 138 secured to the housing 16. The valve 136 is of a kind which is normally open (as it is in the condition shown in FIG. 1), but which is closed when a valve stem 140 is pressed upwardly by an adjustable screw 142 on an arm 144 pivoted on the valve, which occurs when the trigger 26 is squeezed and a cam 146 rigidly fixed on the trigger acts on a cam roll 148 mounted on the arm 144.

When the valve 136 is open, air passes through a pipe 150 (see also FIG. 2) into the bore 46 of the housing 16. From the bore 46, air can pass (unless obstructed as hereinafter described) through a passage 152 (FIG. 4) in the wall of the housing 16 and through a one-way valve 154, and then through a pipe 156. The valve 154 has a plunger 158 backed up by a spring 161 abutting a screw 163 by which the pressure at which the plunger 158 yields to allow air to pass through the pipe 156 can be adjusted; unless air under pressure is issuing through the passage 152, the plunger 158 closes the exit 160 and prevents air passing the other way. The valve 154 is provided on a split collar 155 clamped to the sleeve portion 40 of the housing 16 by a screw 157 (FIG. 1).

The pipe 156 is rigid, and when the abutment assembly is latched in the position shown in FIG. 4, the forward end of the pipe is received in a rubber sealing collar 162, bonded to the sleeve portion 78 of the arm 74 at the mouth of a passage 164 which leads to a bore 166 in the support 82. The bore 166 leads from the passage 164 to the recess 98 behind the piston 100; thus, when air under pressure from the hose 132 reaches the recess 98, the piston 100 is urged forwardly from the position shown in FIG. 6 to that shown in FIG. 7 to open the abutment members 108,110.

Air from the hose 132 passing through the bore 48 can also (unless obstructed as hereinafter described) pass by the jaw case 30 into the sleeve portion 40 of the housing and then through the hole 64 in the boss 66, through the shaft 102 and between the abutment members 108,110. Such passage of air is sufficiently restricted by the mandrel stem in the hole 64 for sufficient pressure to be exerted on the piston 100 to open the members 108,110 while yet affording sufficient flow to propel a rivet R (FIG. 6) forwardly along the mandrel stem as far as the head 120. The bore 46 is sealed from escape of air except at its forward end.

Figure 8:
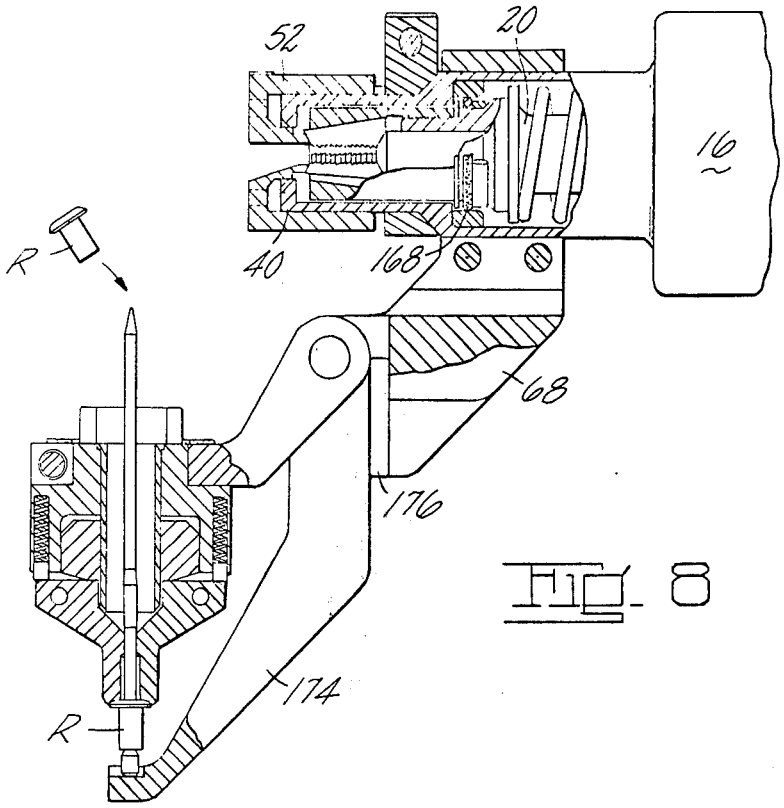
FIG. 8 is a view similar to FIGS. 5, 6, and 7 but showing the illustrative tool in a loading condition, as also depicted in FIG. 3.
Figure 9:
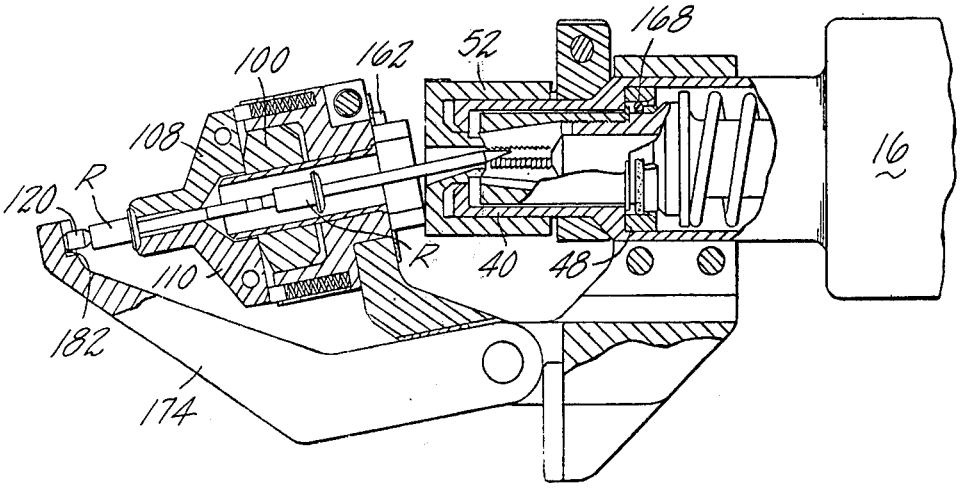
FIG. 9 is a view similar to FIGS. 5 to 8 but showing the illustrative tool at a stage when a mandrel stem is being re-introduced into the pulling means.

The piston 100 is thus urged forwardly in the operation of the illustrative tool when the trigger 26 is released and while the power coupling 20 has not yet returned to its foremost position (see FIGS. 2, 6, and 7). At the same time, release of the trigger 26 reverses the action of the piston in the cylinder 14, and the power coupling 20 is moved forwardly by the spring 22 at a rate controlled by the return of hydraulic fluid from the housing 16 to the bore in the hand grip, as hereinbefore referred to. During most of this forward movement, air from the pipe 150 can pass from the bore 46 through the passage 152 and into the sleeve portion 40 thus opening the members 108,110 and propelling a rivet along the mandrel stem. But as the coupling 20 reaches its foremost position in the housing, a sealing ring 168 (FIGS. 2 and 4) pushed by a collar 170 seated against a flange of the coupling squeezes itself past the chamfer 50 and into sealing engagement with the inner surface of the collar 48 (FIGS. 5, 8 and 9). Air is thus prevented from escaping from the bore 46. The ring 168 is retained on the coupling 20 by a retained washer 172 captive between a shoulder on the coupling and the rear end of the jaw case.

A cycle of operation of the illustrative tool and a convenient mode of loading it will now be described with reference especially to FIGS. 5 and 9.

With the illustrative tool in the condition shown in FIGS. 1 and 5, one rivet R is in front of the closed abutment members 108,110 adjacent the head 120 of the mandrel 34, and another is loose on the mandrel stem in the shaft 102. The valve 136 is open and air is under pressure in the bore 46, but the air cannot escape because the sealing ring 168 is seated in the collar 48. The valve 154 is closed. The mandrel 34 is gripped by the jaws 32. The operator inserts the outside or leading rivet R in a hole in the workpiece W (FIG. 6) and squeezes the trigger 26 to close the valve 136 and initiate a rivet-setting stroke of the power coupling 20, which causes the rivet to be set and the mandrel head 120 retractively pulled clear of the rivet into the cavity 118 defined by the abutment members 108,110, which during setting of the rivet have engaged the rivet head and held it against bodily movement relative to the workpiece. The tool (in the condition shown in FIG. 6) can now be removed from the rivet and the trigger 26 released.

Following release of the trigger, the valve 136 opens and air under pressure both opens the valve 154 and pushes the piston 100 forward to open the abutment members 108,110 and also propels the inner rivet R on the mandrel stem forward between the open members to the mandrel head (FIG. 7). The mandrel remains gripped by the jaws 32, as the power coupling 20 moves forward until arrested by engagement of the washer 172 with the shoulder 44. Shortly before the coupling 20 reaches its foremost position, the sealing ring 168 has re-engaged the collar 48 and sealed the bore 46; at such time the valve 154 will have closed on reduction of air pressure around the jaw case 30, residual compressed air behind the piston 100 escaping slowly enough past the piston, both the inside and outside, to ensure that the now outer rivet remains at the head 120 of the mandrel and the members 108,110 close behind it under the influence of the spring-pressed plungers 124. The tool is thus restored to the condition shown in FIG. 5, except there is no second or inner rivet on the mandrel stem.

The operator may now retract the latching sleeve 52 by means of the finger piece 54 with the result that the jaws 32 are moved by the boss 66 sufficiently far rearwardly to release the mandrel stem, and the sleeve 52 releases the arcuate lugs 86 of the abutment support 82. The abutment assembly 72 now swings downwardly upon the pivot 76 to a loading postion, shown in FIG. 8, in which it is arrested by engagement of the arm 74, between its yokes, with a stop member 174. The member 174 is freely pivoted on the pin 76 between the yokes of the arm 74 and is itself arrested from anticlockwise rotation beyond the position shown in FIGS. 1 and 8 by engagement with a buffer 176 on a depending projection of the strap 68. To facilitate swinging of the assembly 72 with the mandrel 34 between its latched and loading positions without interference from the sleeve 52 when the sleeve is retracted, (retraction of the sleeve is limited by the collar 155) a lower part of the hole 64 in the boss 66 of the latching sleeve 52 is relieved at 178 (FIGS. 3 and 6) to allow for movement of the rear end portion of the mandrel stem, and the arcuate slots 62 of the sleeve 52 are likewise relieved at their lower sides at each end, viz. at 180, to allow for movement of the lugs 86, as depicted in FIG. 3.

As the abutment assembly swings into its loading position, FIG. 8, the head 120 of the mandrel 34 comes to rest in an open-ended recess 182 of the stop member 174. The operator may now feed another rivet R on to the exposed tail end of the mandrel stem and by means of the member 174 swing the abutment assembly 72 up again into its latched position, as represented in FIG. 9. The jaws 32 and the latching sleeve 52 yield rearwardly at such time aginst the influence of the spring 38 to allow introduction of the mandrel 34 and the lugs 86, the sleeve being urged forwardly again by the spring to latch the support 82 in position and to allow the jaws 32 to grip the mandrel stem again. The operator then releases the member 174, which swings back to its out-of-the-way position against the buffer 176.

Engagement of the mandrel head 120 in the recess 182 of the stop member 174 is important in loading the illustrative tool as it ensures the mandrel assumes the correct lengthwise position relative to the jaws 32. Such position must allow sufficient spacing of the head 120 from the members 108,110 to allow them to close behind the fresh rivet when it is propelled forwardly after the next rivet-setting operation.

If desired, spring means or a latch can be provided on the illustrative tool to hold the stop member 174 against the buffer 176 except when it is swung upwardly by the operator, to avoid its swinging uncontrolled if riveting with the mandrel pointing downwards.

Whereas in the operation of the illustrative tool as hereinbefore described, the enlarged portion 128 of the mandrel 34 is relied upon only to preclude the mandrel from falling out of the tool when it is released from the jaws 32, such enlarged portion can, in suitable circumstances, provide an annular shoulder at its forward end and serve to position the mandrel lengthwise of the jaws 32 before they re-engage the mandrel after assembly thereon of a fresh rivet. In such a circumstance, rear edges of the abutment members 108,110 would serve instead of the stop member 174 to position the mandrel by engagement with such shoulder, and the member 174 could be dispensed with. The shoulder could be the front end of an enlarged portion of the mandrel stem or the rear end of a peripheral groove in the mandrel stem.

Having thus described my invention, what I claim as new and desire to secure by Letters Patent of the United States is:

1. A pull-through blind riveting tool comprising a housing, a rivet-setting mandrel having a head and a stem and movable toward and from an operating position in the housing, mandrel-pulling means reciprocably mounted in the housing, an assembly for movably supporting the mandrel and including abutment means openable to allow axial passage of a head of a rivet on the mandrel and closeable to abut the rivet head during relative mandrel retraction, and means interconnecting the assembly and the housing permitting their limited relative separation and approach to allow a rivet to be assembled on the mandrel stem when the mandrel head is engaged and positioned by the relatively separated assembly.

2. A tool as in claim 1 having means for releasing mandrel gripping jaws of the mandrel-pulling means from the mandrel stem, mechanism for thereafter causing the jaws to again grip the mandrel stem, and a stop means engageable by the mandrel to position it lengthwise relative to the mandrel-pulling means when the mandrel is thus to be re-gripped.

3. A tool as in claim 2 wherein the stop means comprises a member engagable endwise by the mandrel head and pivotally secured to the housing for carrying the mandrel between a rivet-reloading position and coaxial relation with said mandrel pulling means.

4. A tool as in claim 3 wherein a releasable latching means secures the mandrel in said coaxial relation.

5. A blind riveting tool comprising a housing, an assembly pivotally mounted on the housing and adapted to carry a headed mandrel movably mounted therein while coaxially supporting one or more rivets on a stem of the mandrel, said assembly including abutment means relatively closeable to engage the head of a leading rivet on the mandrel when the latter is aligned with the housing and openable to allow another rivet on the mandrel to pass along the mandrel stem and be engaged by said abutment means when the leading rivet has been set, mechanism including jaws for axially pulling the mandrel through the leading rivet to set it in a workpiece, and means for releasing the mandrel from said jaws.

6. A tool as in claim 5 having pneumatic means for slidably advancing a rivet on the stem toward the head of the mandrel and through said abutment means, said pneumatic means being operable when said assembly is pivoted from an out-of-the-way position to realign the mandrel and the rivet thereon with said mechanism.

7. A tool as in claim 5 having means yieldable axially of the housing for latching said assembly thereto when the mandrel carried by the assembly is aligned with said housing.

8. A tool as in claim 5 wherein movable means is interposed between the jaws and said assembly for effecting release of the jaws from a mandrel stem gripped thereby.

* * * * *